US005163618A

United States Patent [19]

Cordua

[11] Patent Number: 5,163,618

[45] Date of Patent: Nov. 17, 1992

[54] SEALING DEVICE

[76] Inventor: Paul M. Cordua, 556 S. Mirage, Lindsay, Calif. 93247

[21] Appl. No.: 771,177

[22] Filed: Oct. 4, 1991

Related U.S. Application Data

[63] Continuation of Ser. No. 338,990, Apr. 17, 1989, abandoned.

[51] Int. Cl.[5] ..... B05B 15/02; B05B 15/10

[52] U.S. Cl. ..... 239/205; 239/107

[58] Field of Search ..... 239/204-206, 239/203, 107, 109

[56] References Cited

U.S. PATENT DOCUMENTS

| | | | |
|---|---|---|---|
| 3,580,506 | 5/1971 | Costa | 239/230 |
| 3,776,463 | 12/1973 | Dyck | 239/204 |
| 4,729,511 | 3/1988 | Citron | 239/205 |
| 4,790,481 | 12/1988 | Ray | 239/204 |

*Primary Examiner*—Andres Kashnikow
*Assistant Examiner*—Kevin P. Weldon
*Attorney, Agent, or Firm*—Worrel & Worrel

[57] ABSTRACT

A sealing device for sprinklers and the like having predetermined pressurized and unpressurized conditions, the device having a body portion; an attachment member mounted on the body portion for releasable attachment to the sprinkler; a wall mounted on the attachment portion defining a passage extending through the body portion for releasing fluid from the sprinkler externally of the body portion when the sprinkler is in the pressurized condition; and a sealing plate mounted on the body portion and engageable with a portion of the sprinkler in the unpressurized condition to seal the passage of the body portion against fluid entering the sprinkler therethrough.

6 Claims, 3 Drawing Sheets

SEALING DEVICE

This is a continuation of copending application Ser. No. 07/338,990 filed on Apr. 17, 1991, now abandoned.

BACKGROUND OF THE INVENTION

1. Field of the Invention

The present invention relates to a sealing device and more particularly to a sealing device adapted for use on a fluid system, such as that having sprinklers, to permit flushing of debris from the system and being operable to prevent such matter from reentering the system after such flushing has been completed.

2. Description of the Prior Art

There are a variety of environments in which the initial installation and operation of a fluid system necessitates clearing or flushing of the system prior to it being placed in a fully operative condition. For example, in the installation of sprinkler systems such as used for irrigation, the systems must be vented prior to installation of the sprinkler nozzles thereof to discharge matter such as dirt, sand, metal or plastic particles, pipe sealing compounds and adhesive fragments. If this is not done prior to installation of the nozzles, such matter can become lodged in the orifices thereof during initial pressurization of the system. Where this occurs, the obstructed nozzles must be removed, the matter dislodged from the orifices or the nozzles replaced, and the sprinkler system again vented of such matter.

The process of removing or replacing sprinkler nozzles in the installation of sprinkler systems is not only tedious and time consuming, but is expensive in the manual labor required therefor and in the cost of the replacement nozzles. Furthermore, particularly in commercial installations where large numbers of sprinkler nozzles may be involved, the cleaning or replacement of such nozzles is typically incompletely or inadequately performed to the extent that the sprinkler system is to that extent ineffectual.

Because of these difficulties, it has been known in the industry to use shipping caps which are installed on sprinklers at the time of manufacture in place of the nozzles permitting the sprinkler system to be vented for the discharge of such debris prior to installation of the nozzles. This has the additional benefit of sealing the interior of the sprinkler during shipping and installation and permitting any desired nozzle to be installed in the sprinkler after installation. For example, the Groendyke U.S. Pat. No. 4,752,033 shows one such cap intended for this purpose.

However, all such prior art shipping caps have been ineffectual to one degree or another in that no positive seal is formed preventing matter from flowing back into the sprinkler once the flushing operation has been performed. Thus, even though such prior art shipping caps have assisted to a degree in accomplishing the stated objectives, they have not completely occluded the sprinkler against an influx of such matter and, accordingly, have been less than satisfactory for the intended purpose.

Therefore, it has long been known that it would be desirable to have a sealing device adapted to cooperate with the normal operation of a sprinkler to seal the interior thereof when the sprinkler is at or near an unpressurized condition; which permits flushing of deleterious matter from the interior of the sprinkler during installation without the concomitant hazard of such matter being drawn back into the interior of the sprinkler upon depressurization of the system; is operable to facilitate removal thereof for replacement with a sprinkler nozzle subsequent to the flushing operation; and which is both practical and inexpensive as well as fully dependable in achieving its intended objectives.

SUMMARY OF THE INVENTION

Therefore, it is an object of the present invention to provide an improved sealing device operable in the flushing of a fluid system and particularly well suited to use with sprinklers and the like.

Another object is to provide such a sealing device which provides positive sealing of the sprinkler preventing the admission of debris to the interior thereof when the sprinkler is in an unpressurized condition.

Another object is to provide such a sealing device which is operable to permit flushing of the interior of the sprinkler on which it is installed for the discharge of any debris contained there within, but which operates to seal the sprinkler as it returns to an unpressurized condition but before such condition is reached so that flushing continues up to the very instant that a positive seal is achieved thereby absolutely precluding the influx of foreign matter to the interior of the sprinkler after such flushing has taken place.

Another object is to provide such a sealing device which facilitates the positioning of the sprinkler in an attitude permitting the convenient removal of the sealing device for replacement with a sprinkler nozzle.

Another object is to provide such a sealing device which allows the flushing of a sprinkler system and of the sprinkler on which it is mounted by releasing fluid therethrough and which simultaneously deflects the fluid so released laterally of the sprinkler and from the face of installing personnel.

Further objects and advantages are to provide improved elements and arrangements thereof in an apparatus for the purpose described which is dependable, economical, durable, and fully effective in accomplishing its intended purposes.

DESCRIPTION OF THE PREFERRED EMBODIMENT

Figure 4:
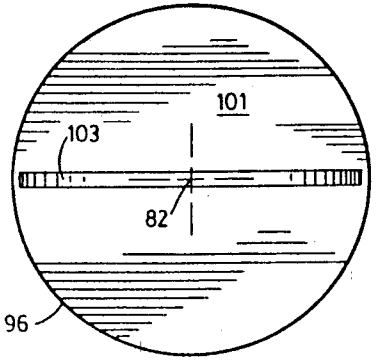
FIG. 4 is a top plan view of the sealing device.
Figure 3:
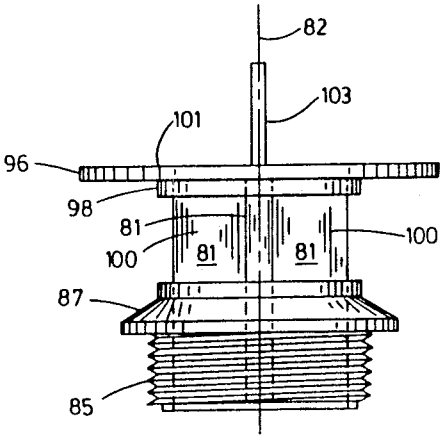
FIG. 3 is a side elevation of the sealing device from a position rotated 90 degrees from the position shown in FIG. 2.
Figure 1:
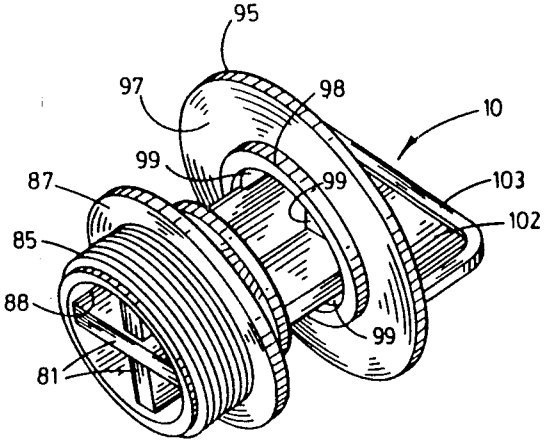
FIG. 1 is a perspective view of the sealing device of the present invention.
Figure 2:
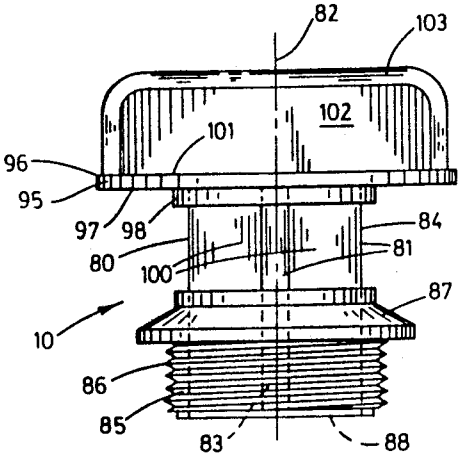
FIG. 2 is a side elevation of the sealing device.
Figure 5:
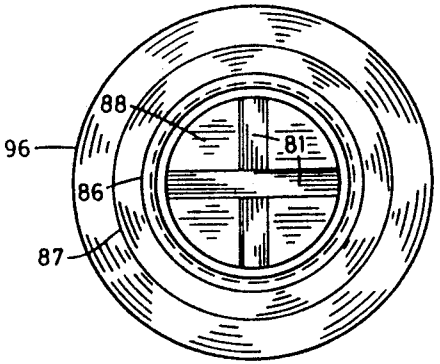
FIG. 5 is a bottom plan view of the sealing device.

Referring more particularly to the drawings, the sealing device of the present invention is generally indicated by the numeral 10 in FIG. 1. The sealing device is shown in a typical operative environment in FIGS. 6, 7 and 8. It will be understood that the sealing device is operable in a wide variety of operational environments, particularly where flushing of a fluid system is required. The operational environment shown and described herein is merely intended to illustrate one such environment.

A sprinkler system is generally indicated by the numeral 20. The sprinkler system is mounted in the earth 21 beneath the earth's surface 22. For a illustrative convenience, lawn is indicated at 23 and is to be watered or irrigated using the sprinkler system 20. In the conventional fashion, and as will hereinafter be described in greater detail, each sprinkler of the sprinkler system is mounted in such a fashion as to be disposed with its upper end in a recessed area 24 in the earth's surface 22.

Figure 6:
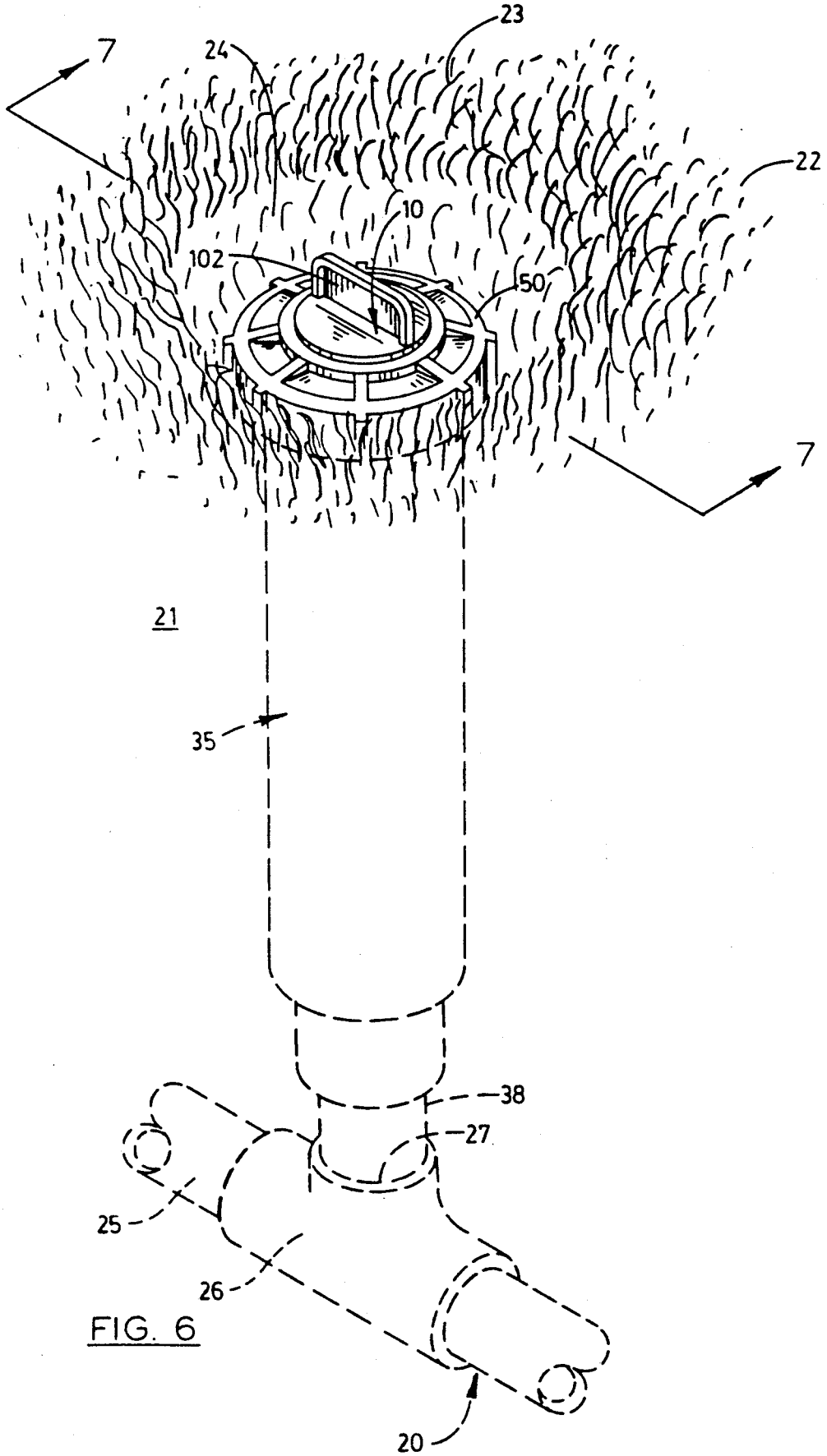
FIG. 6 is a perspective view showing the sealing device of the present invention in a typical operative environment installed on a sprinkler mounted in the earth in fluid communication with a sprinkler system.
Figure 7:
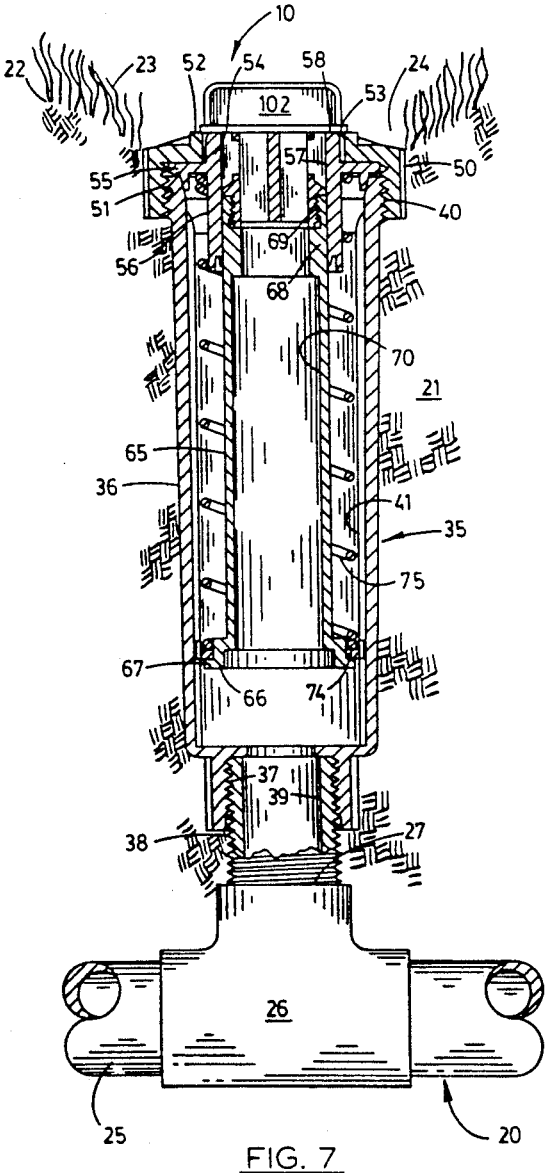
FIG. 7 is a longitudinal, vertical section taken from a position indicated by line 7—7 in FIG. 6 showing the sprinkler in an unpressurized condition with the plunger thereof in a retracted position.
Figure 8:
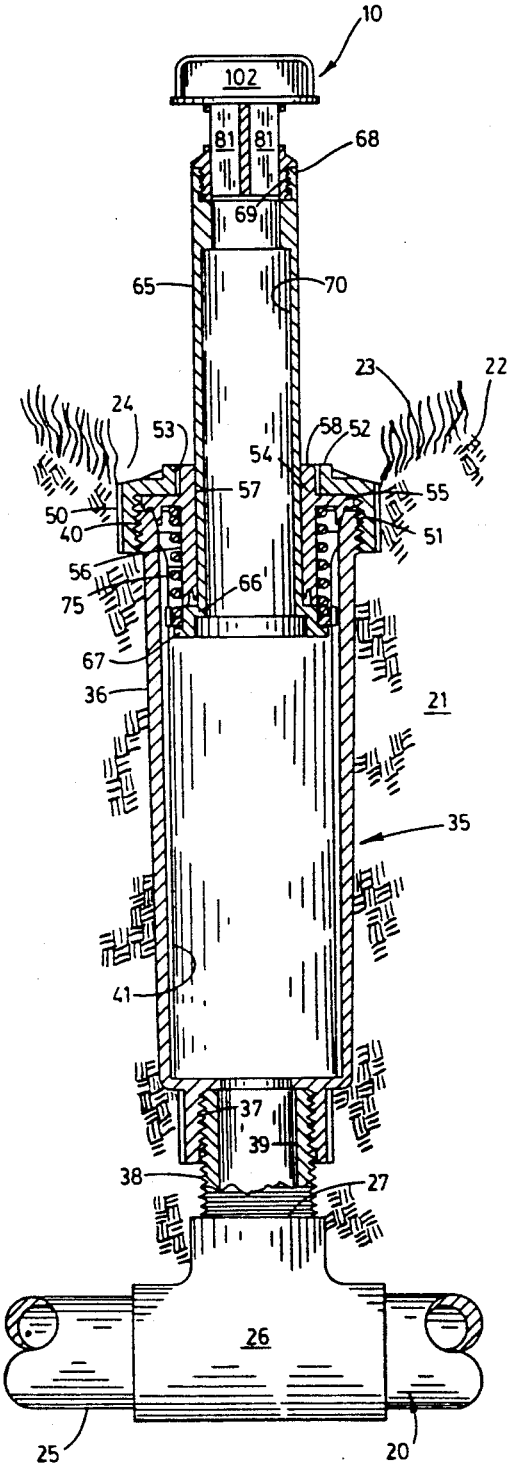
FIG. 8 is a longitudinal, vertical section taken on line 7—7 in FIG. 6 showing the sprinkler in a pressurized condition with the plunger thereof in an extended position.

The sprinkler system 20 has a conduit line 25, shown fragmentarily in FIGS. 6, 7 and 8, in which is mounted a tee fitting 26 having an upwardly facing, internally screw threaded bore 27. It will be understood that the sprinkler system 20 consists of a number of conduit lines 25 connected to a source of fluid under pressure and extending over the area to be irrigated using the sprinkler system. Each of the conduit lines has a plurality of tee fittings 26, or the equivalent, each adapted to mount a sprinkler 35, as will hereinafter be described, in the manner shown for illustrative convenience in FIGS. 6, 7 and 8.

The sprinkler 35 has a housing 36 with an internally screw threaded bore 37 at a lower end thereof. An externally screw threaded coupling 38 is screw-threadably received in the screw threaded bore 27 of the tee fitting 26 and is similarly screw-threadably received in the screw threaded bore 37 so as securely to mount the housing of the sprinkler on the tee fitting. The coupling 38 has an internal passage 39 which operatively interconnects the housing 36 and the conduit line 25 in fluid transferring relation. The housing 36 of the sprinkler has an externally screw threaded upper end portion 40 and encloses a pressure chamber 41.

The sprinkler 35 has a housing cap 50 with internal screw threads 51 adapted screw-threadably to be secured on the screw threaded upper end portion 40 of the housing 36. The housing cap has in the upper surface 52 and a central bore 53. A wiper sealing member 54 is mounted in the housing cap and has a flange 55 which is captured between the housing cap and the upper end portion 40 of the housing, as can best be seen in FIGS. 7 and 8. The wiper sealing member is constructed of a resilient material and has an outer cylindrical surface 56, an internal passage 57 and an upper sealing surface 58 which is substantially flush with the upper surface 52 of the housing cap.

The sprinkler 35 mounts a plunger 65 within the pressure chamber 41 thereof. The plunger has a lower end portion 66 on which is mounted a laterally extending spring flange 67 extending thereabout. The plunger has an upper end portion 68 having an internally screw threaded bore 69 dimensioned to receive a conventional sprinkler nozzle, not shown. As will hereinafter be discussed, the sprinkler nozzle is installed only after the sprinkler system and sprinkler have been cleared of debris. The plunger has a central passage 70 interconnecting the lower and upper end portions of the plunger in fluid transferring relation.

A ring 74 is received on the spring flange 67 extending about the plunger 65. A compression spring 75 is extended about the plunger and is captured between the ring 74 and the flange 55 of the wiper sealing member 54. The compression spring operates in the conventional manner to retain the plunger 65 in a retracted position within the housing while the sprinkler is in an unpressurized condition.

The sealing device 10 of the present invention can best be seen in FIGS. 1 through 5. The sealing device has a body portion 80 including a pair of intersecting walls 81 which intersect along a longitudinal axis 82 of the body portion. The body portion and the intersection walls 81 thereof have a proximal end portion 83 and an opposite distal end portion 84. A mounting portion or coupling 85 is mounted on the proximal end portion 83 of the body portion extending about the intersecting walls and having external screw threads 86. The coupling has a laterally extending flange 87. The coupling extends about the proximal end portion of the intersecting walls forming a passage 88 extending through the coupling intersected by the walls, as can best be seen in FIGS. 1 and 5.

The sealing device 10 has a substantially flat sealing plate 95 mounted on the distal end portion 84 of the intersecting walls 81. The sealing plate has a circular peripheral edge 96 and a sealing surface 97 facing the coupling 85. An annular ridge 98 is mounted on the sealing surface extending about the distal end portions of the walls 81 to form four recesses 99. The coupling 85, the annular ridge 98 and the intersecting walls 81 bound four flushing or discharge parts or discharge openings 100. Thus, four paths of fluid movement are defined extending inwardly through the passage 88 of the coupling 85, along the quadrants defined by the intersecting walls 81 and out through the openings 100 laterally of the sealing device.

The sealing plate 95 has an upper surface 101 on which is mounted a grasping flange 102 in upright relation and bounded by a rib 103.

OPERATION

The operation of the described embodiment of the present invention is believed to be readily apparent and is briefly summarized at this point.

The sealing device 10 of the present invention can be installed in the factory at the time of manufacture so that the sprinkler 35 is received at the time of installation with the sealing device in position. Alternatively, where a sprinkler is to be installed which does not have a sealing device 10 therein, such installation can be accomplished readily just prior to installation. If a sprinkler nozzle, not shown, is mounted in the internally screw threaded bore 69, the operator simply forces the plunger 65 outwardly of the housing 36, holds the plunger and screw-threadably removes the sprinkler nozzle from the internally screw threaded bore 69. The sealing device is then screw-threadably secured using the coupling 85 in the internally screw threaded bore 69 in place of the sprinkler nozzle just removed. The plunger is then released so that the plunger moves to the retracted position shown in FIG. 7 in which the sealing surface 97 of the sealing plate 95 engages the upper sealing surface 58 of the wiper sealing member 54 of the sprinkler 35. If the sealing device 10 has been installed in the factory, the sprinkler 35 would also be in the condition shown in FIG. 7 with the plunger in the retracted position shown therein and the sealing surface 97 engaging the upper sealing surface 58 of the wiper sealing member 54.

The sprinkler 35 is installed on the sprinkler system 20 by screw threading the coupling 38 into the screw threaded bore 27 of the tee fitting 26, as shown in FIG. 7 and 8, to mount the sprinkler in upstanding relation. Of course, at the time of such installation, a hole has been dug down to and about the tee fitting to provide access thereto. Once the sprinkler has been installed as described, the earth is filled into the hole so formed so that the earth's surface 22 is restored to the general configuration shown in FIGS. 6, 7 and 8 with a recessed area 24 about the housing cap 50. If installed in a lawn area, typically a section of lawn will have been removed from about the site for the sprinkler prior to digging of the hole and installation of the sprinkler. Thus, the section of lawn can be repositioned on the earth's surface about the sprinkler and will grow back in such a manner that the lawn is returned substantially to its original condition.

Once all of the sprinklers 35 have been installed in the manner described, conventional practice calls for flushing or venting of the sprinkler system 20 by pressurizing the line and discharging water therethrough to carry all debris from the system which might otherwise clog the sprinkler nozzles. However, in accordance with the present invention, the sealing devices 10 are mounted in place of the sprinkler heads at this time. Accordingly, the operator pressurizes the sprinkler system from a source of water under pressure, not shown. Pressurization of the sprinkler system causes water under pressure to pass from the conduit line 25, through each of the tee fittings 26. For each such tee fitting and sprinkler, the water under pressure passes upwardly through the internal passage 39 and into the pressure chamber 41 of the housing 36 of the sprinkler. This causes water under pressure to pass into the central passage 70 of the plunger 65 and move the plunger against spring pressure to the extended position shown in FIG. 8. Water under pressure passes through the passage 88 of the coupling 85 of the sealing device and to be discharged outwardly through the openings 100. Water is deflected laterally by contact with the recesses 99 and the horizontal sealing surface 97 of the sealing plate 95. The water is deflected laterally of the sprinkler and not upwardly into the face of the operator.

Once the sprinkler system 20 has been flushed of debris so as to avoid the clogging sprinkler nozzles, installation of the sprinkler nozzles on the respective sprinklers 35 is the next step. The operator shuts off the supply of water to the sprinkler system which causes the pressure within the sprinklers 35 gradually to return to an unpressurized condition. As this occurs, and, for example, as the pressure within the pressure chamber 41 of the housing 36 falls to approximately 5 pounds per square inch, the pressure within the pressure chamber is insufficient to over come the pressure exerted by the compression spring 75. The compression spring thus retracts the plunger to the retracted position shown in FIG. 7. Because fluid pressure within the pressure chamber has not reached zero, fluid is still flowing outwardly through the openings 100 as the sealing surface 97 contacts the upper sealing surface 58 of the wiper sealing member 54 to terminate such flow. As a consequence, the sprinkler is sealed before fluid and debris can flow back into the sprinkler through the openings 100. Accordingly, the interior of the sprinkler system is not recontaminated by the influx of debris as the system is depressurized.

After drawing off any water about the housing cap 50, or allowing it to drain off or evaporate, the operator simply grasps the grasping flange 102 of the sealing device 10 in the manner previously described and pulls the plunger 65 from the housing to the position shown in FIG. 8 overcoming the operation of the compression spring 75. The operator than grasps the plunger, screw-threadably removes the sealing device from the s screw threaded bore 69 and installs the desired sprinkler head in its place. Upon releasing the plunger, the compression spring returns the plunger to a retracted position and the sprinkler is rendered fully operational. The retracted position for the plunger with the sprinkler nozzle mounted thereon will typically be farther within the housing than is shown in FIG. 7 depending upon the configuration of the particular sprinkler nozzle employed.

Thus, it will be seen that the sealing device of the present invention operates positively to prevent the reintroduction of debris and fluid to a sprinkler once flushing of debris from the sprinkler has been achieved. The sealing device is of such construction that it can be reused if desired on subsequently installed sprinklers. Similarly, the sealing device can be employed at a later date in flushing a particular sprinkler when a sprinkler nozzle thereof requires replacement.

Therefore, the sealing device of the present invention is adapted to cooperate with the normal operation of a sprinkler to seal the interior of the sprinkler when the sprinkler is at or near an unpressurized condition; permits flushing of deleterious matter from the interior of the sprinkler during installation without the concomitant hazard of such matter being drawn back into the interior of the sprinkler upon depressurization of the system; is operable to facilitate removal thereof from the sprinkler after such flushing for replacement by a selected sprinkler nozzle; and is both practical and inexpensive as well as fully dependable in achieving its intended objectives.

Although the invention has been herein shown and described in what is conceived to be the most practical and preferred embodiment, it is recognized that departures may be made therefrom within the scope of the invention which is not to be limited to the illustrative details disclosed.

Having described my invention, what I claim as new and desire to secure by Letters Patent is:

1. A temporary sealing device for use in installing a sprinkler nozzle in a sprinkler in which said sprinkler has a housing adapted for attachment to a source of fluid under pressure, a plunger having an internally screw threaded distal end portion adapted to receive a sprinkler nozzle and movable through an opening in the housing, about which an annular sealing surface is extended, by fluid pressure within said housing from a retracted position, when said sprinkler is in an unpressurized condition with said distal end portion received within said housing, to an extended position, when said sprinkler is in a pressurized condition, with said distal end portion disposed externally of said housing, the sealing device comprising:

an externally screw threaded mounting portion adapted screw-threadably to be received in the internally screw threaded distal end portion of the plunger and having a passage extending therethrough oriented along a longitudinal axis;

at least one wall mounted on said mounting portion in substantial alignment with the longitudinal axis and extending to a remote end portion;

a sealing plate mounted on the remote end portion of the wall and having a sealing surface substantially facing the mounting portion in substantially right angular relation to said longitudinal axis whereby, when said sprinkler is in said pressurized condition with the plunger in said extended position, fluid passes through the plunger, said passage of the mounting portion of the sealing device, along said wall and is deflected laterally of the sealing device by the sealing plate, and, when said sprinkler is in said unpressurized condition, the sealing plate of the sealing device engages said sealing surface of the housing in fluid sealing relation to prevent fluid and matter borne thereby from passing into the sprinkler, and a grasping member mounted on the sealing plate on a side thereof opposite said sealing surface of the sealing plate and extended therefrom for grasping, when the sprinkler is in said unpressurized condition, to pull the sealing device and plunger to which it is attached from said retracted position so that the plunger can be grasped for removal of the sealing device from the screw threaded distal end portion of the plunger and replacement with a nozzle.

2. A sealing device for use in flushing a sprinkler prior to installing a nozzle in the sprinkler wherein the sprinkler has predetermined pressurized and unpressurized conditions and an opening adapted to receive a nozzle through which fluid is discharged when the sprinkler is in said pressurized condition, the sealing device comprising a body portion having a fluid passage communicating with the atmosphere through a flushing port, said flushing port having a cross sectional area of substantially the same size as said opening of the sprinkler; means mounted on the body portion for impermanently mounting said body portion on the sprinkler with said passage thereof in fluid receiving relation to the opening of the sprinkler to release fluid and extraneous material from the sprinkler through said flushing port of the body portion when the sprinkler is in the pressurized condition; and a sealing member mounted on the body portion adjacent to said flushing port for engagement with a portion of the sprinkler substantially to seal said flushing port, and thereby the sprinkler, as the sprinkler returns to said unpressurized condition against fluid and extraneous material entering the sprinkler therethrough subsequent to said flushing.

3. The sealing device of claim 2 wherein said sealing member has a surface facing said flushing port oriented to deflect fluid and extraneous material released through the flushing port from the sprinkler laterally thereof.

4. A sealing device for use in installing a nozzle in a sprinkler having predetermined pressurized and unpressurized conditions, a plunger which is resiliently retained in a retracted position in said unpressurized condition, which has an opening adapted to receive a nozzle through which fluid is discharged when the sprinkler is in said pressurized condition and which can be pulled from the retracted position against said resilient retention, the sealing device comprising a body portion having a fluid passage communicating wit the atmosphere through a discharge port; means mounted on the body portion for impermanently mounting said body portion on the sprinkler with said passage thereof in fluid receiving relation to the opening of the sprinkler to release fluid from the sprinkler through said discharge port of the body portion when the sprinkler is in the pressurized condition; a sealing member mounted on the body portion adjacent to said discharge port for engagement with a portion of the sprinkler substantially to seal said discharge port, and thereby the sprinkler, as the sprinkler returns to said unpressurized condition against fluid and the like entering the sprinkler therethrough; and a grasping member mounted on the body portion of the sealing device for grasping, when said sprinkler is in said unpressurized condition, to pull the sealing device and plunger to which it is attached from said retracted position so that the plunger can be grasped to permit installation of a nozzle in said opening of the sprinkler upon removal of the sealing device therefrom.

5. A device for use in flushing a sprinkler prior to installing a nozzle in the sprinkler wherein the sprinkler has predetermined pressurized and unpressurized conditions and an opening adapted to receive a nozzle through which fluid is discharged when the sprinkler is in said pressurized condition, the device comprising a body portion having a fluid passage communicating with the atmosphere through a flushing port operable to direct a fluid stream passing therethrough laterally thereof; and means mounted on the body portion for impermanently mounting said body portion on the sprinkler with said passage thereof in fluid receiving relation to the opening of the sprinkler to release fluid and extraneous material from the sprinkler through said flushing port laterally of the body portion when the sprinkler is in the pressurized condition.

6. A device for use in flushing a sprinkler prior to installing a nozzle in the sprinkler wherein the sprinkler has predetermined pressurized and unpressurized conditions and an opening adapted to receive a nozzle through which fluid is discharged when the sprinkler is in said pressurized condition, the device comprising a body portion having a fluid passage communicating with the atmosphere through a flushing port; means mounted on the body portion for impermanently mounting said body portion on the sprinkler with said passage thereof in fluid receiving relation to the opening of the sprinkler to release fluid and extraneous material from the sprinkler through said flushing port of the body portion when the sprinkler is in the pressurized condition; and a sealing member mounted on the body portion adjacent to said flushing port for engagement with a portion of the sprinkler substantially to seal said flushing port, and thereby the sprinkler, as the sprinkler returns to said unpressurized condition against fluid and extraneous material entering the sprinkler therethrough subsequent to said flushing.

* * * * *

UNITED STATES PATENT AND TRADEMARK OFFICE

CERTIFICATE OF CORRECTION

PATENT NO. : 5,163,618

DATED : November 17, 1992

INVENTOR(S) : Paul M. Cordua

It is certified that error appears in the above-indentified patent and that said Letters Patent is hereby corrected as shown below:

Column 4, Line 11

Delete the word "intersection", and Insert the word ---intersecting---

Column 6, Line 7

Delete the word "than", and Insert the word ---then---

Column 6, Line 8

Delete the letter "s" following the word "the"

UNITED STATES PATENT AND TRADEMARK OFFICE

CERTIFICATE OF CORRECTION

PATENT NO. : 5,173,618

DATED : November 17, 1992

INVENTOR(S) : Paul M. Cordua

It is certified that error appears in the above-indentified patent and that said Letters Patent is hereby corrected as shown below:

Column 7, Line 18

Delete ",", Insert ---;---

Column 8, Line 4

Delete the word "wit", and Insert the word ---with---

Signed and Sealed this

Fifth Day of October, 1993

*Attest:*

*Attesting Officer*

BRUCE LEHMAN

*Commissioner of Patents and Trademarks*